US005941724A

United States Patent [19]

Reed

[11] Patent Number: 5,941,724

[45] Date of Patent: Aug. 24, 1999

[54] LOCKABLE FEMALE ELECTRICAL RECEPTACLE

[76] Inventor: Ross E. Reed, 609-A New York Ave., Lynn Haven, Fla. 32444

[21] Appl. No.: 08/899,839

[22] Filed: Jul. 24, 1997

[51] Int. Cl.[6] ..... H01R 4/50

[52] U.S. Cl. ..... 439/346

[58] Field of Search ..... 439/346, 140, 439/188, 261

[56] References Cited

U.S. PATENT DOCUMENTS 3,891,289 6/1975 Hanke ..... 439/346

4,530,556 7/1985 Bonus ..... 439/346

*Primary Examiner*—Steven L. Stephan

*Assistant Examiner*—Eugene G. Byrd

*Attorney, Agent, or Firm*—George A. Bode; Lisa D. Charouel; Bode & Associates

[57] ABSTRACT

A lockable electrical female connector for locking therein prongs of a male plug comprising a female receptacle housing wherein the housing comprises a first cavity and a second cavity wherein the first cavity is isolated from the second cavity. The lockable female electrical connector further comprises a ground receptacle member housed in the first cavity, a first electrical receptacle member housed in the second cavity wherein the first electrical receptacle member comprises a first slot; and a second electrical receptacle member housed in the second cavity wherein the second electrical receptacle member comprises a second slot. The prongs of a male plug are receive in the ground receptacle member and the first and second electrical members and are locked therein via a locking wedge member. The locking wedge member is nested between the first electrical receptacle member and the second electrical receptacle member and is traversed forward via a single knob.

17 Claims, 2 Drawing Sheets

LOCKABLE FEMALE ELECTRICAL RECEPTACLE

BACKGROUND OF THE INVENTION

1. Field of the Invention

The present invention relates to lockable electrical connectors and, more particularly, to a lockable electrical female connector, such as, without limitation, a female receptacle connector for use with extension cords, capable of accommodating therein a male plug having at least two prongs. The locking features of the lockable electrical female connector serve to allow the prongs of the male plug to be quickly and easily locked and unlocked.

2. General Background

As is known, electrical connectors comprise a female receptacle connector and a male plug capable of being received in such female receptacle connector for transferring power, usually from the power contacts of the female receptacle connector to the prongs of the male plug. The male/female connection is maintained by a friction fit between the mated connection of the male plug and the female receptacle connector. Metallic channels of the female receptacle connectors are often stretched because of the repeated insertion and retraction of the prongs of the male plug from such channels. Moreover, prongs of the male plug vary in dimensionality. Therefore, thinner prongs are oftentimes loosely supported within such channels. The loosely supported prongs of the male plug in the female receptacle connector are not sufficiently friction fitted and on occasion become disengaged thereby breaking the flow of electrical power. The user will then reconnect the male plug in the female receptacle connector. This is time consuming and bothersome when a user has a job to perform. This is particularly bothersome on construction sites.

Even if the male/female connection is not broken but the prongs of the male plug recede outwardly from the female receptacle connector, the prongs may become bent or broken or poor or faulty electrical power flow between the metal contacts between the male/female connection may arise. Hazardous conditions exist by the loose electrical contact between the male/female connection wherein arcing or overheating may occur.

Several devices have been patented which are aimed at locking the prongs of the male plug and in the female receptacle connector housing to prevent disengagement of the male plug from the female receptacle connector.

U.S. Pat. No. 4,061,409, by Bealmear, teaches a releasable locking means for preventing the accidental separation of the male plug from the female receptacle connector. A prong of the male plug has a notch formed therein which engages a pin member of a rotatable knob. As the notch is coupled to the pin member, the prong is prevented from accidentally becoming separated from the female receptacle connector.

U.S. Pat. No. 4,530,556, by Bonus, discloses a safety electrical receptacle which is coupled to a conventional wall outlet. The prongs of the male plug are coupled in the wall outlet in a conventional manner via the safety electrical receptacle. The safety electrical receptacle serves to lock the prongs in the safety electrical receptacle thereby the prongs are prevented from being pulled out from the wall outlet. As can be readily seen, the safety electrical receptacle taught by Bonus serves as an adaptor for allowing the prongs of the male plug to be locked to a conventional wall outlet. The safety electrical receptacle taught by Bonus comprises a locking wedge member moved in the vertical plane. A special tool must be used to move the locking wedge in its locking and unlocking positions. As can be appreciated, the invention, by Bonus, does not allow the prongs to be quickly and easily locked and unlocked. Moreover, on occasion such tool has become misplaced thereby the safety electrical receptacle cannot be locked.

The invention, by Bonus, also provides for a ball member to be inserted in the locking wedge member wherein the ball member has coupled thereto a screw means. The ball member tends to wear the interior surfaces of the locking wedge thereby the ball member begins to twist and turn in the locking wedge member. As can be appreciated, as the ball member twists and turns, the locking wedge member eventually cannot be easily moved, if at all, between the locking position and the unlocking position.

Furthermore, the invention, by Bonus, provides for two locking wedges which serve to secure the prongs in the prong-receiving slots when actuated by the movement by the locking wedge member. The locking wedges are not secured to the prong-receiving slots and are susceptible to becoming displaced.

U.S. Pat. No. 4,867,697, by Borges, discloses a self-locking electrical receptacle with a spring-biased wedge for expanding the male plug's prongs within the electrical receptacle. Expanding of the male plug's prongs is problematic in that the prongs become bent and may not be readily inserted in other electrical receptacles.

U.S. Pat. No. 5,551,884, by Burkhart, Sr., teaches a lockable electrical socket which has a pair of grasping jaws which can retain an electrical plug in place. The plug can be released by pushing in the plug and then allowing the plug retaining assembly and the plug to be thrust out under spring pressure. Alternately, the invention, by Burkhart, Sr., discloses the use of a key to thrust out the plug.

Other patents present in the art are U.S. Pat. No. 2,528,121, by Dickinson; U.S. Pat. No. 2,732,531, by Janowiec; and, U.S. Pat. No. 3,891,289, by Hanke; all of which are directed to lockable electrical receptacle connectors for locking therein prongs of male plugs, but do not meet the needs of the lockable electrical female connector of the present invention.

SUMMARY OF THE PRESENT INVENTION

The preferred embodiment of the lockable electrical female connector of the present invention solves the aforementioned problems in a straight forward and simple manner. What is provided is a lockable electrical female connector, such as, without limitation, a female receptacle connector for use with extension cords, capable of accommodating therein a male plug having at least two prongs. The locking features of the lockable electrical female connector serve to allow the prongs of the male plug to be quickly and easily locked and unlocked.

The lockable electrical female connector of the present invention comprises: a means for housing, said housing means comprises a first cavity and a second cavity wherein said first cavity is isolated from said second cavity; a ground receptacle means permanently or demountably housed in said first cavity for providing a ground potential; first electrical receptacle means permanently or demountably housed in said second cavity for providing a first electrical potential, said first electrical receptacle means comprises a first slot; second electrical receptacle means permanently or demountably housed in said second cavity for proving a second electrical potential, said second electrical receptacle means comprises a second slot; and, wedge means for locking nested between said first electrical receptacle means and said second electrical receptacle means wherein as the locking wedge means is traversed forward, said locking wedge means serves to provide a force of pressure to said first electrical receptacle means and said second electrical receptacle means to simultaneously narrow said first slot and said second slot, respectively.

In view of the above, it is an object of the present invention to provide a lockable female electrical receptacle connector which has isolated cavities for isolating the power contacts.

Another object of the present invention to provide such a lockable female electrical receptacle connector which has a geometrically shaped screw head which prevents the rotation of the screw even after significant wearing of the engaging surfaces.

A further object of the present invention is to provide a lockable female electrical receptacle connector with a locking wedge member which is traversed in a forward and backward direction in the horizontal plane. Therefore, in the unlocked position, gravitational forces do not tend to cause movement of the locking wedge member back into the locked position.

It is a still further object of the present invention to provide such a lockable female electrical receptacle connector which locks a male plug therein without regard to the friction fit coupling of the ground prong in the ground receptacle member.

It is a still further object of the present invention to provide such a lockable female electrical receptacle connector which uses a single knob for locking and unlocking easily and effortlessly the prongs of a male plug in the lockable female receptacle connector.

It is a still further object of the present invention to provide such a lockable female electrical receptacle connector which will accommodate therein all common variations of standard male electrical plugs.

In view of the above objects, it is a feature of the present invention to provide a female electrical receptacle connector which is easy to lock and unlock without the need for keys or special tools.

It is another feature of the present invention to provide a female electrical receptacle connector which is easy and inexpensive to manufacture.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals and, wherein.

DETAILED DESCRIPTION OF THE PREFERRED EMBODIMENT

Figure 1:
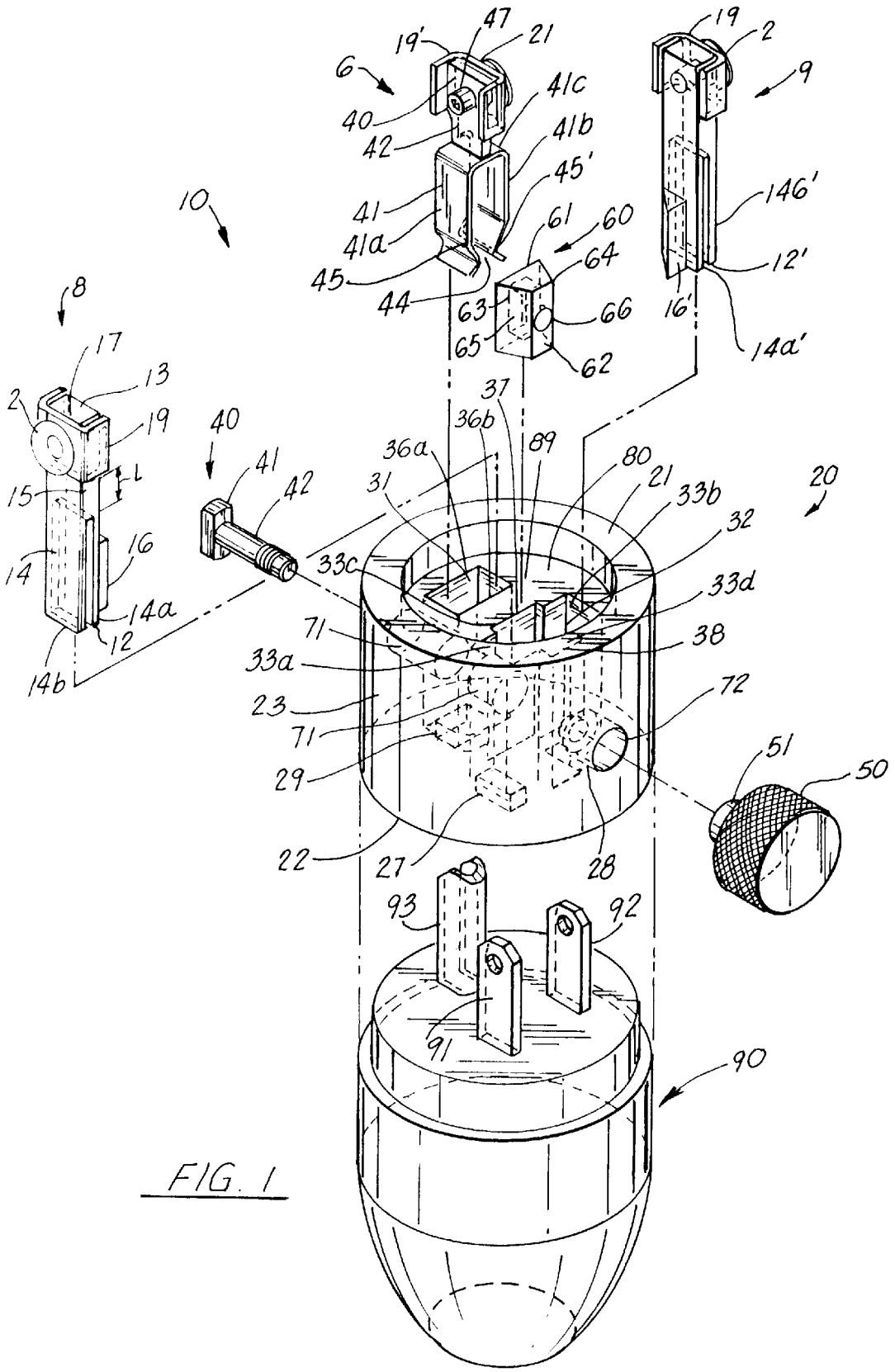
FIG. 1 illustrates an exploded view of the lockable electrical female connector of the preferred embodiment of the present invention and a at least two prong male plug.

Referring now to the drawing, and in particular FIG. 1, the lockable electrical female connector of the present invention is designated generally by the numeral 10. Lockable electrical female connector 10 is generally comprised of ground receptacle member 6, first and second electrical receptacle members 8 and 9, receptacle housing 20, trapezodially-shaped locking wedge member 60, screw 40 and knob 50.

Receptacle housing 20 comprises a cylindrically shaped member defined by top surface 21, bottom surface 22 and continuous curved surface 23. Bottom surface 22 has formed therein first and second prong receiving apertures 27 and 28 parallelly aligned for receiving therein parallel prongs 91 and 92, respectively, of at least two prong male plug 90. Bottom surface 22 further has formed therein ground prong receiving aperture 29 for receiving therein ground prong 93. Although the preferred embodiment provides for a cylindrically shaped receptacle housing 20, any other geometrically shaped receptacle housing may be substituted provided that such geometrically shaped receptacle housing is capable of accommodating standard electrical male plugs with at least two prongs. In the preferred embodiment, receptacle housing 20 is made of a non-conductive material with insulating properties such as, without limitation, rubber-like material.

Top surface 21 has formed therein shallow circular recess 80 wherein recess surface 89 of shallow circular recess 80 has formed therein the openings to first cavity 31 and second cavity 32 wherein first cavity 31 and second cavity 32 extend longitudinally in receptacle housing 20 and end just above bottom surface 22. First cavity 31 is a box-shaped conduit for receiving therein ground receptacle member 6 wherein ground receptacle member 6 receives therein groung prong 93. Second cavity 32 comprises first, second, third and fourth alcoves 33*a*, 33*b*, 33*c* and 33*d* thereby forming a hollow cross-shaped conduit. First and second alcoves 33*a* and 33*b* have a depth dimensioned to receive therein first and second electrical receptacle members 8 and 9, respectively, wherein first and second electrical receptacle members 8 and 9 receive and support therein parallel prongs 91 and 92, respectively. The opening of the square-shaped first and second alcoves 33*a* and 33*b* face each other. Likewise, the opening of third and fourth alcoves 33*c* and 33*d* face each other to form said hollow cross-shaped conduit. However, third alcove 33*c* has a shorter depth than at least the depth of fourth alcove 33*d* and the width of third alcove 33*c* is longer than at least the width of fourth alcove 33*d*. Wall 37 of third alcove 33*c* is parallel to wall 36*b* of first cavity 31. Third and fourth alcoves 33*c* and 33*d* are dimensioned to receive therein base 61 and apex surface 62, respectively, of trapezodially-shaped locking wedge member 60.

Receptacle housing 20 has formed therein first hollow passage 71 wherein first hollow passage 71 perpendicularly intersects continuous curved surface 23, parallel walls 36*a* and 36*b* of first cavity 31 and wall 37 of third alcove 33*c*. First hollow passage 71 has a circumference dimensioned to received therein screw head 41 of screw 40 wherein, as lockable electrical female connector 10 is assembled, screw 40 is capable of being received in second cavity 32 via first cavity 31. Additionally, receptacle housing 20 has formed therein second hollow passage 72 wherein second hollow passage 72 perpendicularly intersects continuous surface 23 180° from the center of first hollow passage 71 and wall 38 of fourth alcove 33*d*. Second hollow passage 72 has a circumference dimensioned to received therein pin 51 of knob 50 wherein pin 51 rotates within second hollow passage 72. The axis of first hollow passage 71 is substantially aligned with the axis of second hollow passage 71 wherein threaded shaft member 42 of screw 40 is received in pin 51.

Trapezodially-shaped locking wedge member 60 is defined by base 61, truncated apex surface 62 parallel to base 61, and first and second sloped surfaces 63 and 64. Base 61 has centrally formed therein recess 65 for accommodating therein screw head 41. Trapezodially-shaped locking wedge member 60 has formed in the center thereof conduit 66 which extends from recess 65 to truncated apex surface 62.

Screw 40 comprises screw head 41 having coupled in the center thereof threaded shaft member 42. In the preferred embodiment, screw head 41 and recess 65 are elongated. Therefore, as knob 50 is rotated clockwise or counterclockwise, screw head 41 and threaded shaft member 42 are not capable of rotating within recess 65. As knob 50 is rotated clockwise, threaded shaft member 42 moves forward in pin 51. As knob 50 is rotated counterclockwise, threaded shaft member 42 moves backward. After the repeated turning of knob 50 to lock lockable electrical female connector 10, screw head 41 has a tendency of wear the engaging surfaces of recess 65. As can be appreciated, elongating screw head 41 prevents screw head 41 from turning in recess 65 even after significant wearing of the engaging surfaces. Henceforth, the useful life of lockable electrical female connector 10 can be significantly extended. Although the exemplary embodiment provides for an elongated screw head 41, nevertheless, screw head 41 and recess 65 may be any geometrical shape, such as, without limitation, a square which would serve to prevent circular rotation of screw 40 whenever knob 50 is rotated.

Since first and second electrical receptacle members 8 and 9 are identical, only one such electrical receptacle member 8 will be described in detail. First electrical receptacle member 8 comprises top portion 13, bottom portion 14, neck portion 15 and wedge member 16. First electrical receptacle member 8 is substantially a rectangular shaped member whose length, width and depth are accommodated within first alcove 33*a*. Likewise, second electrical receptacle member 9 is accommodated within second alcove 33*b*. Top portion 13 has formed therein aperture 17. Electrical wires are capable of being connected to first electrical receptacle member 8 by a variety of means. On such method couples C-shaped bracket 19 to top portion 13 via screw 2 received in threaded aperture 17 to thereby grip and enclose any electrical wire passing therebeneath.

Neck portion 15 has a length L dividing top portion 13 and bottom portion 14 wherein neck portion 15 is imbedded within a disc-shaped member (not shown) which is received in shallow circular recess 80 of receptacle housing 20. Such disc-shaped member (not shown) fixedly supports first and second electrical receptacle members 8 and 9 and ground receptacle member 6 such that such receptacle members 6, 8 and 9 remain secured and aligned within first and second cavities 31 and 32.

Bottom portion 13 is defined by that portion of first electrical receptacle member 8 which is below said disc-shaped member (not shown). The depth dimension of bottom portion 14 is substantially divided with the formation of slot 12 wherein two parallel plates 14*a* and 14*b* are formed. Slot 12 is dimensioned to receive therein prong 91 via first aperture 27 wherein first aperture 27 and slot 12 are aligned. Henceforth, prong 91 has an unobstructed path within receptacle housing 20.

First electrical receptacle member 8 is made of an electrically conductive material such as, without limitation, copper, brass or a brass alloy. Parallel plates 14*a* and 14*b* formed by slot 12 are resilient thereby allowing first electrical receptacle member 8 to receive therein prong 91 whose thickness may vary from male plug to male plug. As a result, some prongs may be tightly held in slot 12 while others are loosely held therein. Henceforth, the male/female connection between at least two prong male plug 90 is compromised such that a tight friction fit may not be had. Moreover, the resilient properties of parallel plates 14*a* and 14*b* causes slot 12 to widen as prong 91 is repeated inserted and retracted. Additionally, because of the varying thicknesses of prong 91, slot 12 may widen permanently.

Parallel plate 14*a* has unitarily formed therewith wedge member 16 wherein wedge member 16 is a substantially right angled-shaped wedge having one leg unitarily formed with parallel plate 14*a* and the other leg is substantially parallel with the vertical plane.

Ground receptacle member 6 comprises top portion 40, bottom portion 41, and neck portion 42. Top portion 40 has formed therein aperture 47. Electrical wires are capable of being connected to ground receptacle member 6 by a variety of means. In the exemplary embodiment, C-shaped bracket 19' is coupled to top portion 40 via screw 2' received in threaded aperture 47 to thereby grip and enclose any electrical wire passing therebeneath.

Neck portion 42 has a length dividing top portion 40 and bottom portion 41 wherein neck portion 42 is imbedded within a disc-shaped member (not shown) which is received in shallow circular recess 80 of receptacle housing 20. As described above in relation to first electrical receptacle member 8, such disc-shaped member (not shown) fixedly supports ground receptacle member 6 within first cavity 31. Ground receptacle member 6 is made of an electrically conductive material such as, without limitation, copper, brass or a brass alloy.

Bottom portion 41 is defined by that portion of ground receptacle member 6 which is below neck 42 embedded in said disc-shaped member (not shown). Bottom portion 41 comprises first and second parallel plates 41*a* and 41*b* distanced by perpendicularly coupled plate 41*c*. Parallel plates 41*a* and 41*b* form opening 44 for receiving therein prong 93 whose thickness may vary from male plug to male plug. As a result, some prongs may be tightly held in opening 44 while others are loosely held therein. However, the locking of prongs 91 and 92 in first and second electrical receptacle members 8 and 9 maintain male plug 90 locked within lockable electrical female connector 10 without regard to the friction fit of prong 93 within ground receptacle member 6. In close proximity to the entrance of opening 44 parallel plates 41*a* and 41*b* project inward to form first and second clamping members 45 and 45'. First and second clamping members 45 and 45' serve to clamp ground prong 93 of male plug 90 within ground receptacle member 6 to enhance the friction fit coupling of the male plug within lockable female electrical receptacle member 10.

Ground receptacle member 6 and first and second electrical receptacle members 8 and 9 are either permanently or demountably disposed within first cavity 31 and second cavity 32, respectively. For exemplary purposes, ground receptacle member 6 serves to ground prong 93, first electrical receptacle member 8 serves as a source of electrical energy potential to prong 91 and second electrical receptacle member 9 serves as a neutral potential to prong 92. First cavity 31 and second cavity 32 allow ground receptacle member 6 and first and second electrical receptacle members 8 and 9 to be isolated from each other thereby ground receptacle member 6 is isolated from the electrical energy provided to at least one of first and second electrical receptacle members 8 and 9. More specifically, the isolation of ground receptacle member 6 via first cavity 31 serves prevent ground receptacle member 6 from coming in contact with the electrical energy potential provided to at least electrical receptacle member 8.

In the preferred embodiment, first and second electrical receptacle members 8 and 9 are removeable coupled in first and second alcoves 33*a* and 33*b*, respectively. Nevertheless, first and second electrical receptacle members 8 and 9 maybe permanently affixed within first and second alcoves 33*a* and 33*b*.

In the preferred embodiment, trapezodially-shaped locking wedge member 60 is made of a non-conductive material thereby electrical energy potential is not transferred between first and second electrical receptacle members 8 and 9 via trapezodially-shaped locking wedge member 60. However, screw 40 is preferably made of a durable metallic material because the threads formed in threaded shaft member 42 are more durable with the use of a durable metallic material. Screw 40 is isolated from the electrical energy provided to first and second electrical receptacle members 8 and 9 via the non-conductive material of trapezodially-shaped locking wedge member 60. Therefore, the user is prevented from being shocked when such user turns knob 50.

Trapezodially-shaped locking wedge member 60 is positioned within second cavity 32 such that base 61 is parallel to the vertical plane and wall 37 of third alcove 33*c*. The center of conduit 66 is substantially the center of first and second hollow passages 71 and 72. Trapezodially-shaped locking wedge member 60 is nested between wedge member 16 of first electrical receptacle member 8 and wedge member 16' of second electrical receptacle member 9. Threaded screw shaft 42 of screw 40, coupled to trapezodially-shaped locking wedge member 60 via conduit 66, extends through second cavity 32 and is received within a threaded portion (not shown) of pin 51 of knob 50. In operation, as knob 50 is rotated, trapezodially-shaped locking wedge member 60 is moved toward wall 38 of fourth alcove 33*d*. As trapezodially-shaped locking wedge member 60 is moved, trapezodially-shaped wedge member applies a force of pressure to wedge members 16 and 16', simultaneously, such that plates 14*a* and 14*a'* of first and second electrical receptacle members 8 and 9, respectively, are simultaneously urged toward plates 14*b* and 14*b'*, respectively. Thereby prongs 91 and 92 received in first and second electrical receptacle members 8 and 9, respectively, are tightly friction fit coupled within slots 12 and 12', respectively.

Figure 2A:
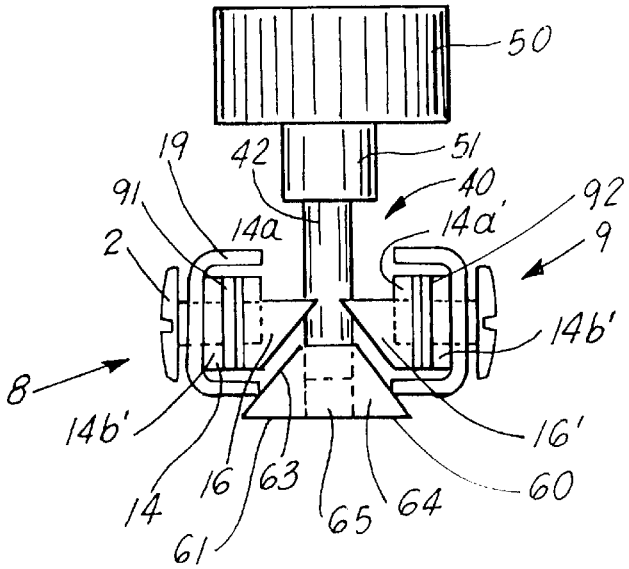
FIG. 2*a* illustrates a view of the trapezodially-shaped locking wedge member in the unlocking state of the present invention; and, FIG. 2*b* illustrates a view of the trapezodially-shaped locking wedge member in the locked state of the present invention.

Referring now to FIG. 2*a*, trapezodially-shaped locking wedge member 60 is shown in its unlocked position. In the unlocked position, trapezodially-shaped locking wedge member 60 does not engage wedge members 16 and 16' wherein a force of pressure is not exerted on wedge members 16 and 16' to urge plates 14*a* and 14*a'* of first and second electrical receptacle members 8 and 9, respectively, toward plates 14*b* and 14*b'*, respectively.

Figure 2B:
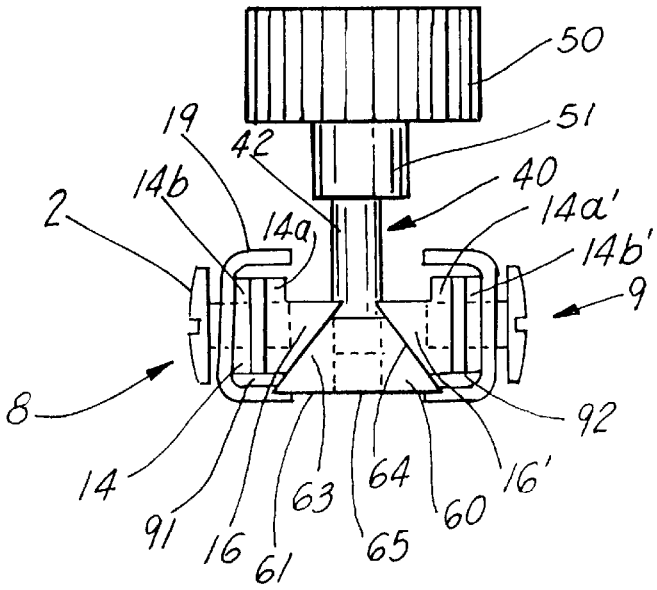

Referring now to FIG. 2*b*, clockwise rotation of knob 50 causes forward translation of trapezodially-shaped locking wedge member 60 until first and second sloped surfaces 63 and 64 engage the respective sloped surfaces of wedge members 16 and 16', respectively. As trapezodially-shaped locking wedge member 60 traverses forward, a force of pressure is exerted on wedge members 16 and 16' and urges plates 14*a* and 14*a'* inwardly such that slots 12 and 12' are narrowed to a point that prongs 91 and 92, respectively, are very tightly friction fit coupled therein. Henceforth, prongs 91 and 92 of male plug 90 are locked within lockable electrical female connector 10.

Since trapezodially-shaped locking wedge member 60 is traversed in a forward and backward direction in the horizontal plane, gravitational forces do not tend to cause movement of trapezodially-shaped locking wedge member 60 back into the locked position, as best seen in FIG. 2*b*.

Counterrotation of knob 50 causes backward translation of trapezodially-shaped locking wedge 60 and the resilient properties of plates 14*a* and 14*a'* of first and second electrical receptacle members 8 and 9, respectively, allow plates 14*a* and 14*a'* to expand to the original position. Thereby the very tight friction fit coupling serving to lock prongs 91 and 92 in slots 12 and 12' is released. Thereafter, prongs 91, 92 and 93 of male plug 90 may be easily and effortlessly receded from lockable female electrical receptacle connector 10.

As can be appreciated, knob 50 allows lockable female electrical receptacle connector 10 to be easily and quickly locked and unlocked. More important, only a single knob (knob 50) is needed to effectively lock and unlock at least two prongs of male plug 90 in lockable female electrical receptacle connector 10.

The preferred embodiment set forth in detail herein describes a lockable female receptacle connector 10 for use with extension cords. Nevertheless, the lockable female receptacle connector of my invention has application with wall outlets and other power outlets.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A lockable electrical female connector comprising:

(a) a means for housing, said housing means comprises:
- a first cavity;
- a second cavity wherein said first cavity is isolated from said second cavity, said second cavity comprises:
  - a first alcove
  - a second alcove,
  - a third alcove, and;
  - a fourth alcove wherein said first alcove faces said second alcove and said third alcove faces said fourth alcove for forming a hollow cross-shaped conduit;
- a first hollow passage wherein said first hollow passage perpendicularly intersects an exterior surface of said housing means, parallel walls of said first cavity and a first wall of said second cavity; and;
- a second hollow passage wherein said second hollow passage perpendicularly intersects said exterior surface of said housing means 180° from the center of said first hollow passage and a second wall of said second cavity;

(b) a ground receptacle means permanently or demountably housed in said first cavity for providing a ground potential;

(c) first electrical receptacle means permanently or demountably housed in said first alcove of said second cavity for providing a first electrical potential, said first electrical receptacle means comprises a first slot;

(d) second electrical receptacle means permanently or demountably housed in said second alcove of said second cavity for providing a second electrical ppotential, said second electrical receptacle means comprises a second slot; and, (e) wedge means for locking nested between said first electrical receptacle means and said second electrical receptacle means wherein as the locking wedge means is traversed forward, said locking wedge means serves to provide a force of pressure to said first electrical receptacle means and said second electrical receptacle means to simultaneously narrow said first slot and said second slot, respectively.

2. The lockable electrical female connector of claim 1, said first electrical receptacle means further comprise a bottom portion having two parallel plates separated by a distance to form said first slot and a first wedge member coupled to one of said two parallel plates; and, said second electrical receptacle means further comprises a bottom portion having two parallel plates separated by a distance to form said second slot and a second wedge member coupled to one of said two parallel plates, wherein as said locking wedge means is traversed forward the force of pressure is applied to said first and second wedge members simultaneously to narrow said first slot and said second slot simultaneously.

3. The lockable electrical female connector of claim 1, wherein said locking wedge means comprises:

a base;

an apex surface parallel to said base;

first and second sloped surfaces; and, a recess centrally formed in said base.

4. The lockable electrical female connector of claim 1, wherein said third alcove has a shorter depth than at least the depth of said fourth alcove and a width of said third alcove is longer than at least the width of said fourth alcove.

5. The lockable electrical female connector of claim 1, further comprising:

a means for screwing having a geometrically shaped head dimensioned to prevent rotation of said head in said recess and a threaded shaft member;

a knob having a pin member for receiving therein said threaded shaft member wherein said pin member is rotatably coupled in said second hollow passage.

6. A lockable electrical female connector for locking therein prongs of a male plug comprising:

(a) a female receptacle housing, said housing comprises a first cavity and a second cavity wherein said first cavity is isolated from said second cavity;

(b) a ground receptacle member permanently or demountably housed in said first cavity;

(c) first electrical receptacle member permanently or demountably housed in said second cavity, said first electrical receptacle member comprises a first slot, a bottom portion having two parallel plates separated by a distance to form said first slot and a first wedge member fixedly coupled to one of said two parallel plates;

(d) second electrical receptacle member permanently or demountably housed in said second cavity said second electrical receptacle member comprises a second slot, a bottom portion having two parallel plates separated by a distance to form said second slot and a second wedge member fixedly coupled to one of said two parallel plates; and, (e) locking wedge member nested between said first electrical receptacle member and said second electrical receptacle member wherein as said locking wedge member is traversed forward, said locking wedge member serves to provide a force of pressure to said first and second wedge members simultaneously to narrow said first slot and said second slot simultaneously.

7. The lockable electrical female connector of claim 6, wherein said locking wedge member comprises:

a base;

an apex surface parallel to said base;

first and second sloped surfaces; and, a recess centrally formed in said base.

8. The lockable electrical female connector of claim 7, wherein said second cavity comprises a first alcove dimensioned to receive therein said first electrical receptacle member;

a second alcove dimensioned to receive therein said second electrical receptacle member;

a third alcove dimensioned to receive therein said base of said locking wedge member; and, fourth alcove dimensioned to receive therein said apex surface, wherein said first alcove faces said second alcove and said third alcove faces said fourth alcove for forming a hollow cross-shaped conduit.

9. The lockable electrical female connector of claim 8, wherein said third alcove has a shorter depth than at least the depth of said fourth alcove and a width of said third alcove is longer than at least the width of said fourth alcove.

10. The lockable electrical female connector of claim 8, wherein said female receptacle housing further comprises:

a first hollow passage wherein said first hollow passage perpendicularly intersects an exterior surface of said female receptacle housing, parallel walls of first cavity and a wall of said third alcove; and, a second hollow passage wherein said second hollow passage perpendicularly intersects said exterior surface of said female receptacle housing 180° from the center of said first hollow passage and a wall of said fourth alcove.

11. The lockable electrical female connector of claim 10, further comprising:

a screw having a geometrically shaped head dimensioned to prevent rotation of said head in said recess and a threaded shaft member;

a knob having a pin member for receiving therein said threaded shaft member wherein said pin member is rotatably coupled in said second hollow passage.

12. A lockable electrical female connector comprising:

(a) a means for housing, said housing means comprises:

a first cavity, a second cavity wherein said first cavity is isolated from said second cavity, a first hollow passage wherein said first hollow passage perpendicularly intersects an exterior surface of said housing means, parallel walls of said first cavity and a first wall of said second cavity, and;

a second hollow passage wherein said second hollow passage perpendicularly intersects said exterior surface of said housing means 180° from the center of said first hollow passage and a second wall of said second cavity;

(b) a ground receptacle means permanently or demountably housed in said first cavity for providing a ground potential;

(c) first electrical receptacle means permanently or demountably housed in said second cavity for providing a first electrical potential, said first electrical receptacle means comprises a first slot;

(d) second electrical receptacle means permanently or demountably housed in said second cavity for proving a second electrical potential, said second electrical receptacle means comprises a second slot; and, (e) wedge means for locking nested between said first electrical receptacle means and said second electrical receptacle means wherein as the locking wedge means is traversed forward, said locking wedge means serves to provide a force of pressure to said first electrical receptacle means and said second electrical receptacle means to simultaneously narrow said first slot and said second slot, respectively.

13. The lockable electrical female connector of claim 12, said first electrical receptacle means further comprising a bottom portion having two parallel plates separated by a distance to form said first slot and a first wedge member coupled to one of said two parallel plates; and, said second electrical receptacle means further comprises a bottom portion having two parallel plates separated by a distance to form said second slot and a second wedge member coupled to one of said two parallel plates, wherein as said locking wedge means is traversed forward the force of pressure is applied to said first and second wedge members simultaneously to narrow said first slot and said second slot simultaneously.

14. The lockable electrical female connector of claim 12, wherein said locking wedge means comprises:

a base;

an apex surface parallel to said base;

first and second sloped surfaces; and, a recess centrally formed in said base.

15. The lockable electrical female connector of claim 12, wherein said second cavity comprises:

a first alcove dimensioned to receive therein said first electrical receptacle means;

a second alcove dimensioned to receive therein said second electrical receptacle means;

a third alcove dimensioned to receive therein said base of said locking wedge means; and, fourth alcove dimensioned to receive therein said apex surface, wherein said first alcove faces said second alcove and said third alcove faces said fourth alcove for forming a hollow cross-shaped conduit.

16. The lockable electrical female connector of claim 15, wherein said third alcove has a shorter depth than at least the depth of said fourth alcove and a width of said third alcove is longer than at least the width of said fourth alcove.

17. The lockable electrical female connector of claim 14, further comprising:

a screw having a geometrically shaped head dimensioned to prevent rotation of said head in said recess and a threaded shaft member;

a knob having a pin member for receiving therein said threaded shaft member wherein said pin member is rotatably coupled in said second hollow passage.

* * * * *